US005285615A

United States Patent [19]

Gilmour

[11] Patent Number: 5,285,615

[45] Date of Patent: Feb. 15, 1994

[54] THERMAL METALLIC BUILDING STUD

[75] Inventor: Michael F. Gilmour, Vancouver, Wash.

[73] Assignee: Angeles Metal Systems, Los Angeles, Calif.

[21] Appl. No.: 967,864

[22] Filed: Oct. 26, 1992

[51] Int. Cl.[5] ..... E04C 3/09

[52] U.S. Cl. ..... 52/729; 52/731.9; 52/735; 52/481

[58] Field of Search ..... 52/729, 731.9, 735, 52/738, 481

[56] References Cited

U.S. PATENT DOCUMENTS

| | | | |
|---|---|---|---|
| 3,243,930 | 4/1966 | Slowinski | 52/731.9 X |
| 3,925,948 | 12/1975 | Sauer et al. | 52/481 |
| 3,940,899 | 3/1976 | Balinski | 52/735 X |
| 4,016,700 | 4/1977 | Blomstedt | 52/735 |
| 4,047,355 | 9/1977 | Knorr | 52/738 |
| 4,235,054 | 11/1980 | Cable et al. | 52/481 X |
| 4,619,098 | 10/1986 | Taylor | 52/738 |
| 4,713,921 | 12/1987 | Minialoff et al. | 52/731.9 X |
| 4,844,975 | 7/1989 | Litzenberger | 52/731.9 X |

FOREIGN PATENT DOCUMENTS

| | | | |
|---|---|---|---|
| 2242538 | 3/1974 | Fed. Rep. of Germany | 52/738 |

*Primary Examiner*—Peter M. Cuomo
*Assistant Examiner*—Suzanne L. Dino
*Attorney, Agent, or Firm*—Harlan P. Huebner

[57] ABSTRACT

A vertical thermal C shaped metallic stud having a web with a pair of spaced apart generally parallel legs extending therefrom forming surfaces to receive exterior and interior wall structures. At least one of said legs including an upset struck outwardly from the leg to act as the bearing surface for wall material to be affixed thereto, so that a thermal space is created between the stud and wall material to prevent transfer or lessen the transfer of ambient exterior air temperature by thermal conductivity to the interior of a building using the thermal C shaped studs.

13 Claims, 2 Drawing Sheets

34'

52'
16'
5b
32'
16'
68
48'
54'
68
5b
34"
6b

34"
70
32"

16"
16"
54"
6b
70
54"
32"
7b
72
56'
72
56'

7b

THERMAL METALLIC BUILDING STUD

BACKGROUND OF THE INVENTION

1. Field of the Invention

This invention relates to a C shaped metallic thermal building stud that is provided with structure to reduce or eliminate thermal conductivity of exterior ambient air temperature through a building to its interior.

2. Description of the Prior Art

In present day architecture buildings as well as homes utilize a support structure of a framework comprising vertical steel C shaped studs positioned between horizontal steel floor and ceiling steel bases and caps, such as illustrated and described in U.S. Pat. No. 4,235,054.

Heretofore, the C shaped studs have had generally smooth end flanges or legs to which interior finish wall boards have been secured to the inside flange. The outside flange or leg usually has attached thereto plywood with an exterior finish such as exterior plaster or a siding attached thereto. With the prior art structure the entire surface of the flanges both exterior and interior are in complete contact with the exterior and interior surfaces of the wall material respectively.

Thus, with full contact ambient exterior air temperature has passed by thermal conductivity through the exterior surface into the flange or leg along its entire surface and the through the C shaped stud web to the interior leg and through the full surface contact with the interior wall into the room. Thus the exterior temperature has passed into a building so that extreme cold or heat renders the interior very uncomfortable.

Such transmission of winter air temperatures in some regions into the house is not only unwanted but increases heating costs to overcome the temperature reduced internal air. Also the opposite is true in the summer when the ambient air may be extremely hot, the temperature is conveyed by the building stud as a thermal conduit directly into the interior of the house or building. Again, this is undesirable because of the interior discomfort and the additional expense of operating air conditioning equipment.

SUMMARY OF THE INVENTION

It is an object of the present invention to provide a thermal C shaped metallic building stud that reduces the area of contact against either or both of the leg sections by exterior building covering such as plaster or a siding and the interior wall surface material to decrease the thermal conductivity of ambient exterior air temperature into the interior of said building.

It is a further object of the present invention to form protuberances on the exterior of either or both of said leg sections of a C shaped metallic building stud to form the thermal C shaped metallic building stud whereby only said protuberances are contacted by building wall material and the area of said protuberances is less than the entire exterior leg area of said stud.

Another object of the present invention is to provide a pattern of protuberances or bumps along the entire length of either or both of said leg sections of a thermal C shaped metallic building stud.

Another object of the present invention is to provide a pattern of bumps along the entire length of either or both of said leg sections of a thermal C shaped metallic building stud with at least one hole passing through each of said bumps to further assist in restricting the passage of ambient exterior air temperature to the interior of a building structure.

A yet further object of the present invention is to provide at least one elongated continuous rib or raised portion struck outwardly from either or both of the legs of a thermal C shaped metallic building stud as the area of contact.

These and other objections and advantages will become apparent from the following part of the specification wherein details have been described for the competence of disclosure, without intending to limit the scope of the invention which is set forth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figure 1:
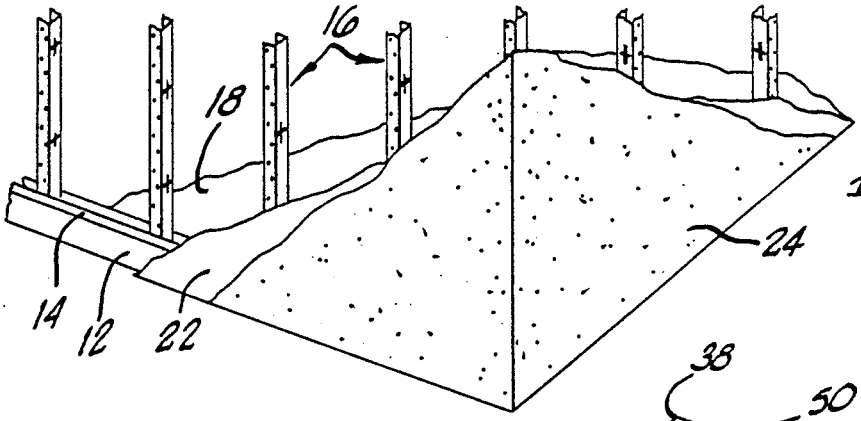
FIG. 1 is an environmental partial sectional view of a building utilizing the new thermal C shaped metallic wall studs of the present invention.

In FIG. 1 there is an environmental view of a partial building structure such as a house generally designated 10. There is the traditional foundation 12 upon which is secured a metallic U shaped horizontal stud holder 14 into which are mounted the new vertical thermal C shaped metallic studs designated 16. Unseen are horizontal metallic U shaped top caps to receive the studs 16 to complete the metal frame of structure 10.

To the interior of the studs 16 conventional wall board 18 (see FIGS. 1 and 3*a* and 3*b*) may be affixed to the studs 16 by conventional wall board nails or fasteners 20. While wall board 18 appears to be the preferred interior surface when using metallic studs the more classic and extensive lath and plaster may be used with equal end thermal results.

Again referring to FIGS. 1, 3 and 6 there is shown an exterior base member such as plywood 22 secured to the various studs 16 by conventional means and forming the outside surface may be exterior plaster 24 adherable to the plywood 22. While plywood and exterior plaster is illustrated any form of exterior siding may be used without effecting the present invention.

The invention resides in the construction of the thermal studs designated 16. Each stud 16 is preferably formed from hot dipped galvanized strip steel having a generally common thickness throughout and of a specific thickness gauge such as from 16 to 27 as prescribed by A.I.S.I. The metallic thermal stud, generally equivalent to a "2 ×4" in wood vernacular, designated 16 includes a web portion 26 having an interior end 28 and an exterior end 30 with the stud at the ends 28 and 30 bent normal to the plane of web 26 forming a pair of opposed parallel legs 32 and 34 each of which is of a lesser width then the width of the web 26. At respective ends 36 and 38 of legs 32 and 34 the metal is preferably bent inwardly normal to the plane of each leg 32 and 34 forming inwardly facing strengthening flanges 40 and 42. In cross section the elongated studs 16 each appear as the letter "C", thus the name C shaped studs.

The web 26 usually includes openings 44 for treading electrical wire conduit within the wall structures of a building 10.

The legs 32 and 34 each include inner and outer walls 46 and 48 and 50 and 52 respectively.

Figure 2:
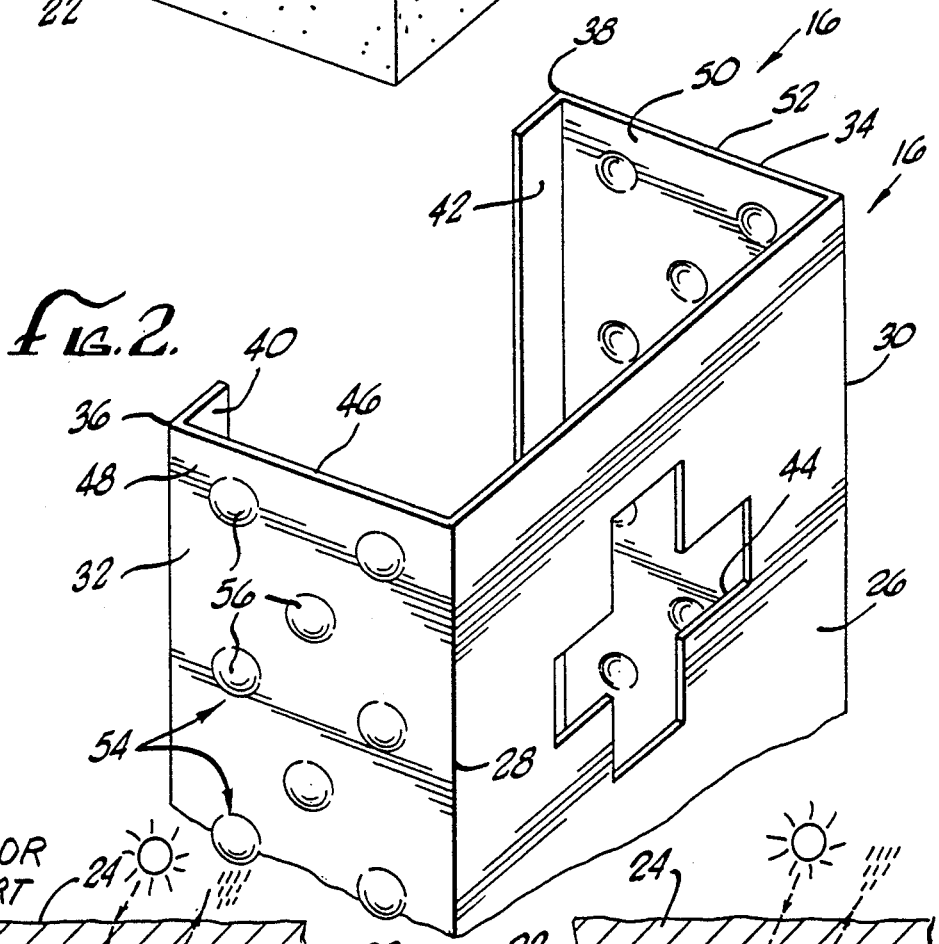
FIG. 2 is a perspective view of the new thermal C shaped metallic wall stud.

In order to create the thermal C shaped metallic stud 16 each of the legs 32 and 34 are formed with a plurality of interruptions or protuberances generally designated 54 along the entire length of each leg 32 and 34. With regard to the stud 10 shown in FIG. 2 the protuberances 54 take the form of generally circular bumps 56 that are pushed from the interior surfaces 46 and 50 outwardly so that the bumps 56 will project beyond the exterior surfaces 48 and 52 of the legs 32 and 34. These are best viewed in FIGS. 2 and 4. In the case of the bumps 56, shown in FIG. 2, there is a pattern of two bumps 56 on a horizontal plane with a single bump 56 vertically spaced from the adjacent two bumps. The pattern is then repeated with a pair and then single bumps on both legs of the stud 16.

While a pattern as just described is preferred it must be realized that a random arrangement of bumps 56 work generally as well as a set pattern.

Figure 4:
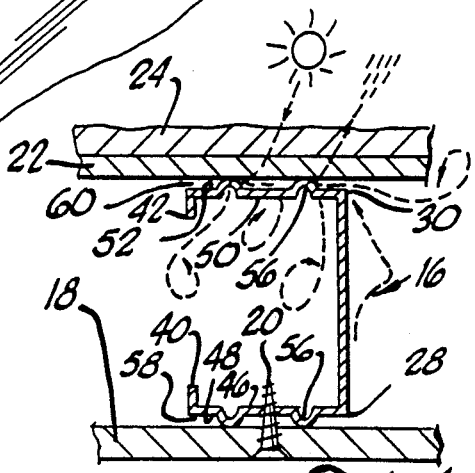
FIG. 4 is a cross sectional view of the new thermal C shaped metallic building stud similar to FIG. 3 but with protuberances to space the building walls away from full stud contact and illustrating the dissipation of ambient air temperature.

When the new studs 16 are used it will be seen in FIG. 4 that the interior wall board 18 is placed against the bumps 56 so that there is a thermal space 58 between the exterior wall 48 and the wall board 18 which shall be the distance the bump or protuberances 54 are stuck from the legs 32 and 34.

The same thing is true with regard to the exterior of the structure, the plywood 22 or siding wall is secured to the leg 34 of the stud and when mounted to the leg 34 will create another thermal space 60.

Figure 3:
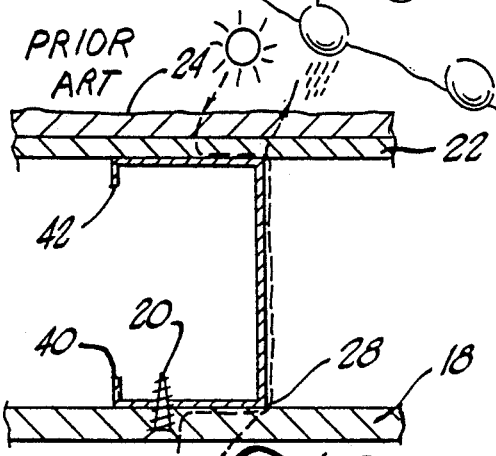
FIG. 3 is a cross sectional view of a prior art C shaped metallic wall stud with exterior and interior walls secured thereto and illustrating the transmission by thermal conductivity of exterior ambient air temperature to the interior of a building.

In the case of prior art C studs as seen in FIG. 3 the entire surfaces of the legs are smooth so that the wall board as well as the exterior wall coverings contact the entire surfaces. Such wide area contact would aid in the transmission of exterior ambient air temperatures by thermal conductivity as seen with the arrows of FIG. 3. The conductively will allow the ambient temperature to pass directly to the entire surface of the exterior leg, through the web and through the interior leg and through the interior wall board into the room. This of course is unwanted for both discomfort and the increase in electrical or gas costs to keep heaters going in the winter and air conditioners going in the summer.

In other words with the plurality of prior art studs and exterior and interior surfaces in full contact, the studs act as an undesired absorption thermal conduit for the exterior air temperature directly into the structure.

However, the present invention eliminates or significantly reduces the thermal transmission of air temperature through the metallic C studs or thermal conduits due to the construction of the legs 32 and 34 with the protuberances 54. Primarily there is less area contact of the walls with the surfaces of exterior wall surface 52 and interior wall surface 48.

In addition, the air spaces or voids 58 and 60 caused by the protuberances 56 will act to dissipate the temperature that passes through the exterior walls 22 and 24 as the air therein is not the conduit of heat or cold as are the solid substances such as the walls prior art metal studs.

Also as the metal stud 16 has the web portion 26, any heat or cold that makes it to the web is further dissipated due to the length of the metal. Finally, with the air space 58 on the interior surface, cold or heat getting as far as the leg 32 is further dissipated before it would contact the interior wall 18.

Figures 5A, 5B, 6A, 6B, 7A, 7B:
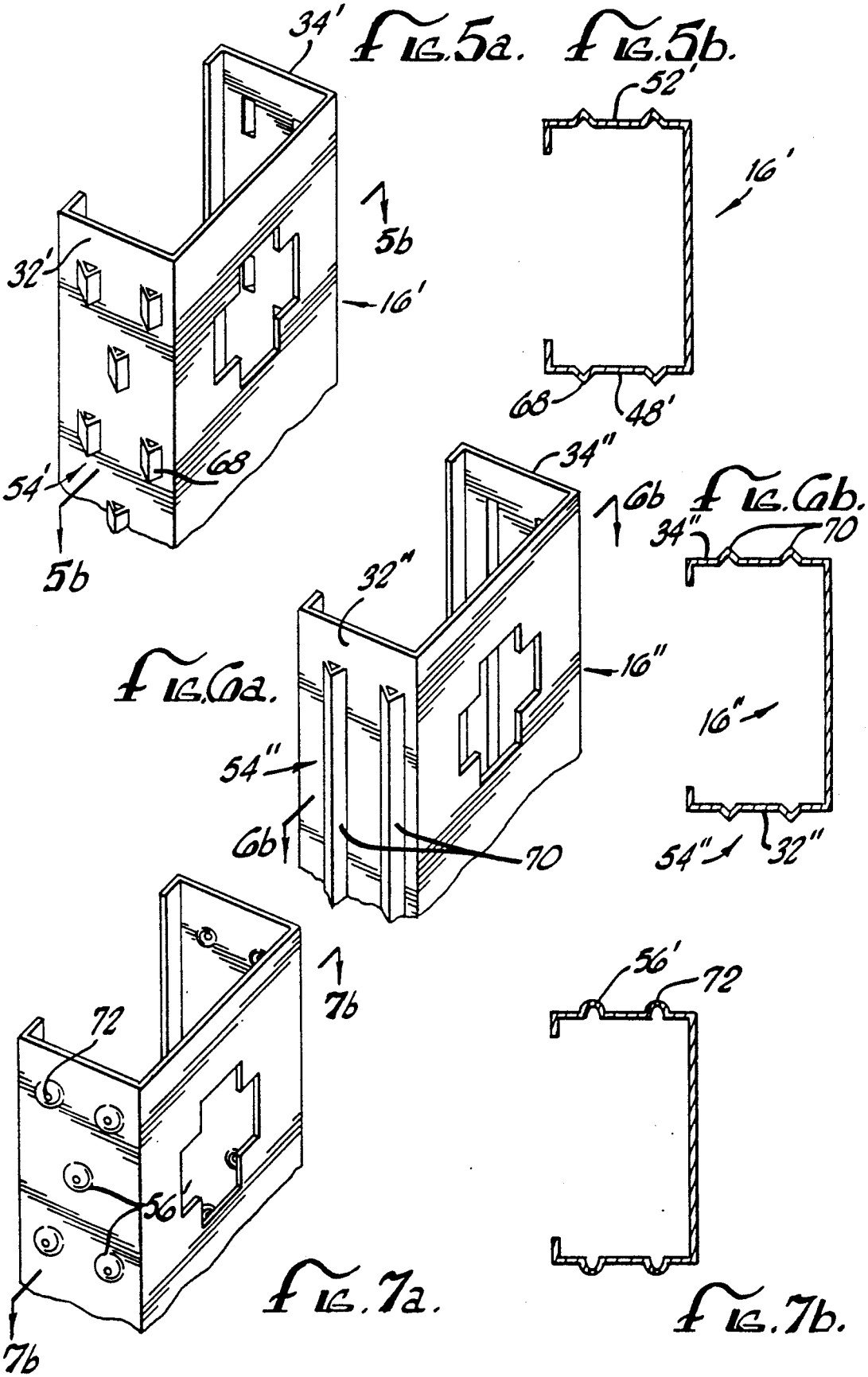
FIG. 5*a* and 5*b* are a modified thermal C shaped metallic building stud.
FIG. 6*a* and FIG. 6*b* a further embodiment of the new C shaped metallic building stud.
FIG. 7*a* and 7*b* is a further modified embodiment of the new C shaped metallic building stud.

In FIGS. 5*a* and 5*b* there is illustrated a modification of the protuberances or interruptions 54, on the legs 32' and 34' The interruptions are V shaped projections 68 that may be struck outwardly from outer walls 48' and 52'. random or in a pattern just so long as they extend the length of the stud 16'.

FIGS. 6*a* and 6*b* illustrate a still further modification of the protuberances 54''. Here V shaped projections 70 are provided that run the length of a C stud 16''. There are preferably two such elongated V shaped projections 70 on each leg 32'' and 34''. Finally, FIGS. 7*a* and 7*b* illustrate another modification of interruptions 54 illustrated in FIGS. 1, 2 and 4. In the circular bumps 56' there is provided a small opening 72 that passes through each bump to again lessen the area of contact by exterior or interior siding and wall material. Such area of reduced contact will further assist in the dissipation of cold or heat temperatures from the exterior ambient air.

While the drawings illustrate and the description discusses the interruptions or protuberances 54 and 54' as being formed on both legs 32 and 34 of the vertical thermal C shaped metallic studs 16, it should be realized that such protuberances could be located on only one leg of the studs 16 without departing from the spirit of the invention. Such construction would still leave a thermal space between either the exterior siding or interior wall of the structure for dissipating the undesired temperature.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. An elongated thermal C shaped metallic building stud including a web portion extending between the exterior and interior of a building and a pair of generally parallel legs bent from said web forming an exterior leg and an interior leg and each leg including a strengthening flange struck inwardly toward each other from the ends of said legs opposite said web and generally parallel therewith, said legs each adapted to have secured along their length by fastening means either exterior or interior wall structures, and each leg having exterior and interior generally smooth planar surfaces, said stud further including:

an upset formed on said smooth surface of the exterior wall of at least one of said legs extending outwardly and said upset is spaced away from the area where said web joins said leg, and there is no upset formed on said web portion, and said upset forming a contact area for said wall structure when said structure is secured to said leg and creating a thermal space between said structure and said generally smooth surface of said leg wherein ambient exterior air temperature, as it may pass by thermal conductivity through said exterior wall structure material, is impeded from conduction through said C shaped metallic building stud and said interior wall material to the interior of said building.

2. An elongated thermal C shaped metallic building stud as defined in claim 1 wherein;

both legs of said stud include upsets formed on the said smooth surface of said exterior planar surfaces thereof so that there are two thermal spaces created to impede conduction of exterior ambient air temperature into said building.

3. An elongated thermal C shaped metallic building stud as defined in claim 1 wherein:

said upset includes protuberances that are circular bumps struck from said interior surface of said leg outwardly through said exterior wall and extend beyond said planar surface of said leg, said circular bumps defining the width of said thermal space.

4. An elongated thermal C shaped metallic building stud as defined in claim 3 wherein:

both legs of said stud include a plurality of circular bumps formed on the length of said exterior walls thereof so that there are two thermal spaces defined by said circular bumps, one on each leg.

5. An elongated thermal C shaped metallic building stud as defined in claim 3 wherein:

said protuberances are arranged on said leg in a preset spaced pattern one from the other along the entire length of said leg.

6. An elongated thermal C shaped metallic building stud as defined in claim 5 wherein:

both legs of said stud include protuberances and two thermal spaces are created, one on each leg.

7. An elongated thermal C shaped metallic building stud as defined in claim 3 wherein:

said protuberances are arranged o said leg in a random pattern spaced one from the other along the entire length of said leg.

8. An elongated thermal C shaped metallic building stud as defined in claim 7 wherein:

both legs of said stud include protuberances and two thermal spaces are created, one on each leg.

9. An elongated thermal C shaped metallic building stud as defined in claim 3 wherein:

said circular bumps each include an opening passing through said leg from said interior to said exterior wall of said leg to further eliminate area contact with wall structure material.

10. An elongated thermal C shaped metallic building stud as defined in claim 3 wherein:

said protuberances are V shaped in cross section and are formed from a deformation of said leg along its entire surface.

11. An elongated thermal C shaped metallic building stud as defined in claim 1 wherein:

a plurality of said building studs are mounted vertically in a base frame and are spaced one from the other to form a frame wall structure for said building.

12. In an elongated thermal C shaped metallic building stud including a web portion extending between the exterior and interior of a building and a pair of generally parallel legs bent from said web forming an exterior leg and an interior leg and each leg including a strengthening flange struck inwardly toward each other from the ends of said legs opposite said web and generally parallel therewith, said legs each adapted to have secured along their length by fastening means either exterior or interior wall structures, and each leg having exterior and interior generally smooth planar surfaces, the improvement comprising:

a plurality of protuberances in the form of circular bumps are struck from said interior surface of said leg outwardly through said exterior wall and extend beyond said generally smooth planar surface of said leg, said protuberances are all formed away from the area where said web joins said leg and no protuberances are formed in said web portion, the height of said circular bumps define the width of a thermal space between said structure and the planar surface of said leg wherein ambient exterior air temperature as it may pass through said exterior wall structure material is impeded from thermal conduction through said C shaped metallic building stud and said interior wall structure to the interior of said building.

13. In an elongated thermal C shaped metallic building stud as defined in claim 13 wherein:

both legs of said stud include a plurality of protuberances formed along the length of said exterior planar surfaces thereof so that there are two thermal spaces created to impede conduction of exterior ambient air temperature into said building.

* * * * *